US009228289B2

(12) United States Patent
Oh

(10) Patent No.: US 9,228,289 B2
(45) Date of Patent: Jan. 5, 2016

(54) WASHING BALL

(71) Applicant: IONFARMS CO., LTD, Incheon (KR)

(72) Inventor: Shin-Taek Oh, Incheon (KR)

(73) Assignee: IONFARMS CO., LTD, Incheon (KR)

( * ) Notice: Subject to any disclaimer, the term of this patent is extended or adjusted under 35 U.S.C. 154(b) by 0 days.

(21) Appl. No.: 14/350,600

(22) PCT Filed: Jan. 4, 2013

(86) PCT No.: PCT/KR2013/002690

§ 371 (c)(1),
(2) Date: Apr. 9, 2014

(87) PCT Pub. No.: WO2014/035023

PCT Pub. Date: Mar. 6, 2014

(65) Prior Publication Data

US 2015/0299933 A1 Oct. 22, 2015

(30) Foreign Application Priority Data

Sep. 3, 2012 (KR) ..... 10-2012-0097044

(51) Int. Cl.

| | |
|---|---|
| ***D06F 39/02*** | (2006.01) |
| ***D06F 35/00*** | (2006.01) |
| ***C11D 17/04*** | (2006.01) |
| ***D06F 39/00*** | (2006.01) |

(52) U.S. Cl.

CPC ..... *D06F 39/024* (2013.01); *C11D 17/046* (2013.01); *D06F 35/00* (2013.01); *D06F 39/00* (2013.01); *D06F 39/02* (2013.01)

(58) Field of Classification Search

CPC ..... D06F 39/024; D06F 39/00; D06F 39/02; C11D 17/046

See application file for complete search history.

(56) References Cited

U.S. PATENT DOCUMENTS

| | | | | | |
|---|---|---|---|---|---|
| 4,835,804 | A * | 6/1989 | Arnau-Munoz | D06F 39/024 | 206/0.5 |
| D384,450 | S * | 9/1997 | Leu | D32/29.1 | |
| 5,768,917 | A * | 6/1998 | Freida | D06F 39/024 | 206/0.5 |
| 6,032,495 | A * | 3/2000 | Leu | D06F 39/024 | 510/439 |
| D579,163 | S * | 10/2008 | Schablinger | D32/29.1 | |
| 7,517,848 | B2 * | 4/2009 | Evans | B01F 1/0027 | 134/25.2 |
| D646,447 | S * | 10/2011 | Lozano | D32/29.1 | |
| 2010/0281928 | A1 * | 11/2010 | Martin | D06F 39/024 | 68/213 |

FOREIGN PATENT DOCUMENTS

| | | |
|---|---|---|
| KR | 20-2000-0020297 | 12/2000 |
| KR | 10-2001-0087780 | 9/2001 |
| KR | 10-2003-0021412 | 3/2003 |
| KR | 10-2009-0082610 | 7/2009 |

* cited by examiner

*Primary Examiner* — Joseph L Perrin
(74) *Attorney, Agent, or Firm* — Lex IP Meister, PLLC

(57) ABSTRACT

Disclosed is a washing ball which comprises a first tubular portion which is formed so as to vertically extend from the center of the upper end of the upper main body; a second tubular portion which is formed so as to vertically extend from the center of the upper end of the lower main body; multiple porous ceramic balls which are filled into both sides of the inside of the lower main body; a blocking film which prevents the multiple porous ceramic balls filled into the lower main body from moving out of position; and a laundry additive container which is removably inserted into the inner sides of the first tubular portion, the blocking film, and the second tubular portion which communicate with each other when the upper main body and the lower main body are coupled together.

4 Claims, 4 Drawing Sheets

WASHING BALL

TECHNICAL FIELD

The present invention relates to a laundry ball, and in particular to a laundry ball which makes it possible to hit laundry in a washing machine in such a way a plurality of spiral waveform protrusions and a plurality of through slits are continuously formed an outer circumferential surface for thereby preventing the tangling of laundry in a washing machine, and a washing agent container is inserted at the inner sides of a first tube part and a second tube part, so a washing agent discharges out in the course of washing for thereby producing good perfume and making the laundry feel smooth, and porous ceramic balls are designed to emit far infrared ray, which enriches the surface activation of washing water while obtaining sterilization and antibacterial effects in laundry.

BACKGROUND ART

Generally speaking, a drum washing machine is installed with its central shaft being arranged in a horizontal direction. Laundry and washing water are mixed in a cylindrical drum. While the drum rotates, washing force is generated depending on the potential energy which is continuously created.

The water to be used in the course of the washing process is fed in a washing agent dissolving device via a water supply valve connected to an outside water supply source. The washing water filled with the washing agent dissolved while passing through the washing agent dissolving device is supplied in a tub. At this time, the washing water is supplied via a water supply hose connected between a diaphragm and a washing agent dissolving device.

The water supply hose is made from a rubber material and is connected to the washing agent dissolving device and the diaphragm by means of a clamp.

However, water and ecosystem continue to be contaminated thanks to overuse of washing agent. In order to improve the above mentioned problems, different types of washing balls are increasingly used so as to do the laundry without using washing agent; however it is reported that its actual application has being retarded due to the decreased effects in sterilization and pasteurization.

The applicant of the present invention, as shown in FIG. 1, invented a washing ball whose Korean Patent Registration No. is 10-2008-0008473 which has features in that a plurality of ceramic balls are provided in a washing ball formed of a wave-shaped protrusion part and a through slit, and a magnet and an aroma stick are disposed inside, thus enriching sterilization and antibacterial operations in the laundry while enhancing surface activation of the washing water, which results in the enhanced washing efficiency.

The washing ball of the above mentioned registered invention is equipped with ceramic balls, magnet and aroma sticks; however its life service is short, and they are not emitted enough to increase washing efficiency.

DISCLOSURE OF INVENTION

Accordingly, it is an object of the present invention to provide a laundry ball which makes it possible to maximize the emission of far infrared ray in such a way to fill porous ceramic balls in a laundry ball, while enhancing surface activation of washing water and sterilization and pasteurization effects.

It is another object of the present invention to provide a laundry ball which makes it possible to enhance washing efficiency in such a way to insert a washing agent container in a washing ball by which washing agent such as fiber softener can be discharged as washing water with the aid of vibrations in the course of washing.

To achieve the above objects, there is provided a laundry ball formed of a semi-spherical upper body and a semi-spherical lower body in which a plurality of spiral wave-shaped protrusions and a plurality of through slits which are continuously formed on its outer circumferential surface and reinforcing ribs are ribbed on the inner circumferential surface in the opposite direction to the through slit wherein the upper body and the lower body are engaged into a spherical shape, comprising a first tubular part which vertically extends from the center of the top of the upper body; a second tubular part which is vertically extends from the center of the top of the lower body; a plurality of porous ceramic balls which are filled into both sides of the inner side of the lower body; a blocking cover which is configured to prevent the leaves of the porous ceramic balls filled in the lower body; and a washing agent container which is detachably inserted into the inner sides of the first tubular part, the blocking cover and the second tubular part which all communicate one another when being engaged to the upper body and the lower body, wherein the washing agent container is formed of a discharge member including a plurality of discharge ports, a valve member including a check valve, and an accommodation part which accommodates a gel semi-solid washing agent, and a thread of the accommodation part is engaged to a thread formed at an inner circumferential surface of the cap.

In the present invention, the wave-shaped protrusion part protrudes in a spiral shape from the centers of the first tubular part and the second tubular part to the bottom edge portion of the upper body and the top edge portion of the lower body, and at the descended side is formed a through slit in a longitudinal direction.

In the present invention, the washing agent container is formed of a discharge member including a plurality of discharge ports, and a valve member including a check valve, and an accommodation part accommodating a get semi-solid washing agent, and a thread is engaged to a thread of the accommodation part. When the washing agent container is used in a drum type washing machine, the discharge port is engaged facing the upper body, and when the washing agent container is used in an ordinary washing machine, the discharge port is engaged facing the lower body.

The check valve is selected among a ball check valve whose valve is spherical, and a conical check valve, and in the stop mode, the check valve blocks the discharge port with the aid of gravity, thus stopping the discharge of the washing agent, and the washing agent is discharged as the check valve, which has blocked the discharge port, moves by an external impact or the vibrations in the course of washing.

The blocking cover includes a plurality of spiral holes at its upper surface and lower surface in order for the washing water to flow, and an insertion part is formed at its center and is inserted into the second tubular part, and at its lower surface are formed a plurality of supports which extend in a longitudinal direction.

Advantageous Effects

The present invention has advantageous effects as follows. Long stained dirt can be removed using washing balls, and laundry can be prevented from tangling, and far infrared ray can be created by porous ceramic balls, thus enhancing surface activations of washing water along with enriched sterilization and antibacterial effects. The washing agent discharged from the inserted washing agent container emits perfume, and clothes can be smoothed while preventing static electricity, and color losing can be prevented, and washing agent does not remain after washing, and wrinkle-free washing can be obtained.

BRIEF DESCRIPTION OF DRAWINGS

The present invention will become better understood with reference to the accompanying drawings which are given only by way of illustration and thus are not limitative of the present invention, wherein.

BEST MODES FOR CARRYING OUT THE INVENTION

The detailed examples of the present invention will be described with reference to the accompanying drawings.

Figure 1:
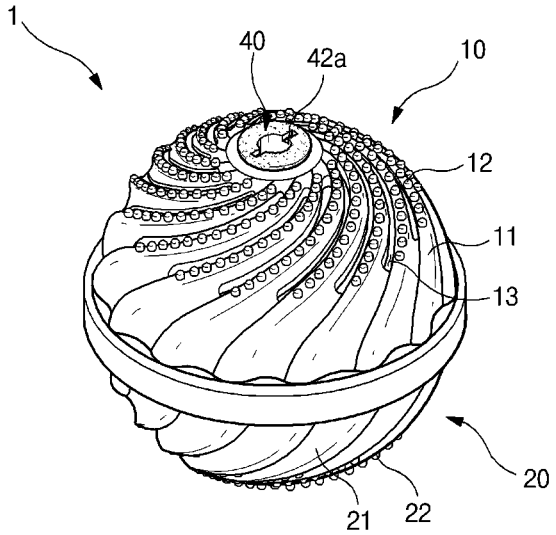
FIG. 1 is a perspective view illustrating a conventional washing ball.
Figure 2:
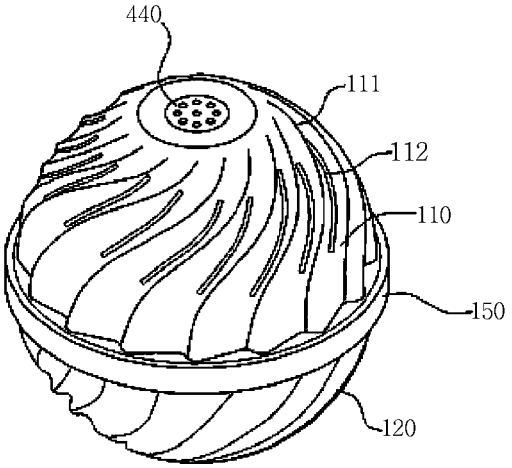
FIG. 2 is a perspective view illustrating a washing ball according to an embodiment of the present invention.

As shown in FIG. 2, the washing ball according to the present invention comprises a semi-spherical upper body 110 on an outer circumferential surface of which are continuously formed a plurality of spiral wave-shaped protrusions 111 and through slits 112, and a lower body 120 which is configured in the same shape as the upper body 110, wherein the upper body 110 and the lower body 120 are engaged each other. Into its center is inserted a washing agent container 400.

Figure 6:
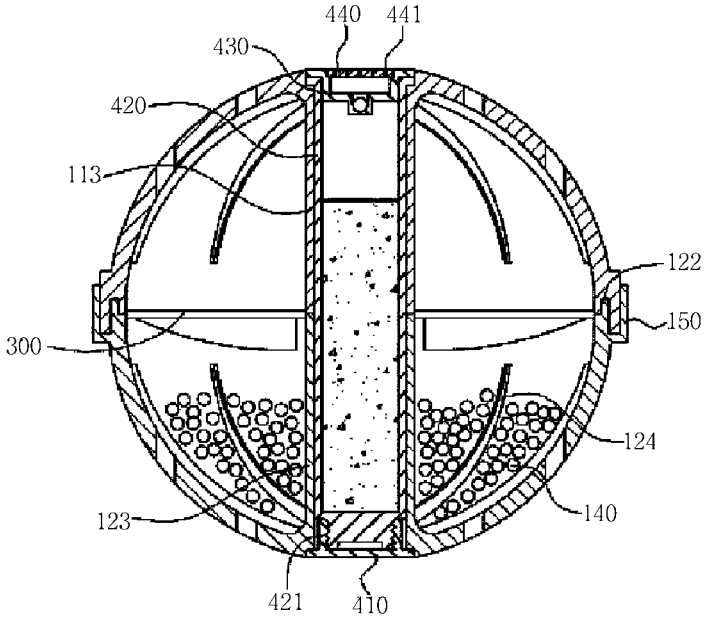
FIG. 6 is a cross sectional view illustrating a washing ball according to an embodiment of the present invention.
Figure 7:
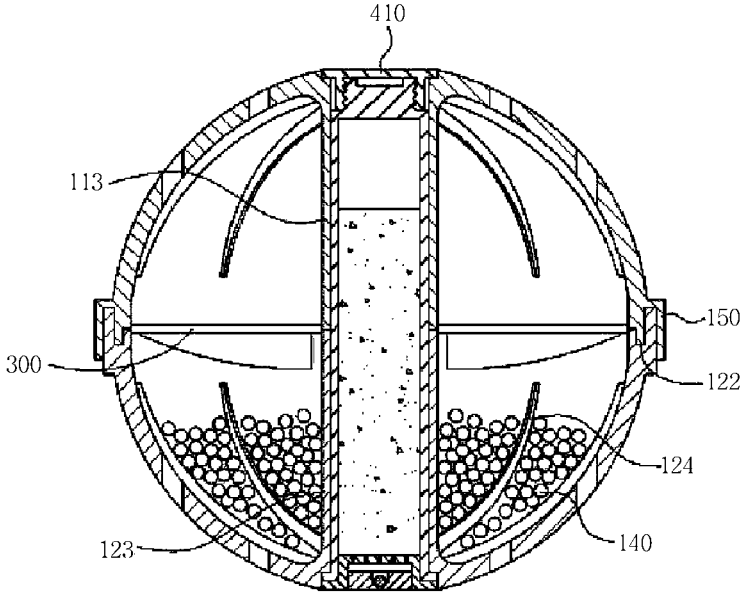
FIG. 7 is a cross sectional view illustrating a washing ball according to another embodiment of the present invention.

The spiral wave-shaped protrusions 111 and the through slit 112 both formed on an outer circumferential surface of the upper body 110 are configured to remove dirt by hitting the laundry and to prevent the laundry from tangling. It is preferred that the washing ball 100 is made from a smooth plastic material, so that it can move in a rotating washing tub and hit the laundry. An insertion protrusion 150 is disposed at an inner edge portion of the upper body 110, and as shown in FIGS. 6 and 7, it matches with an insertion groove 122 formed at an inner side of the lower body 120 for thereby forming a spherical configuration.

Figure 3:
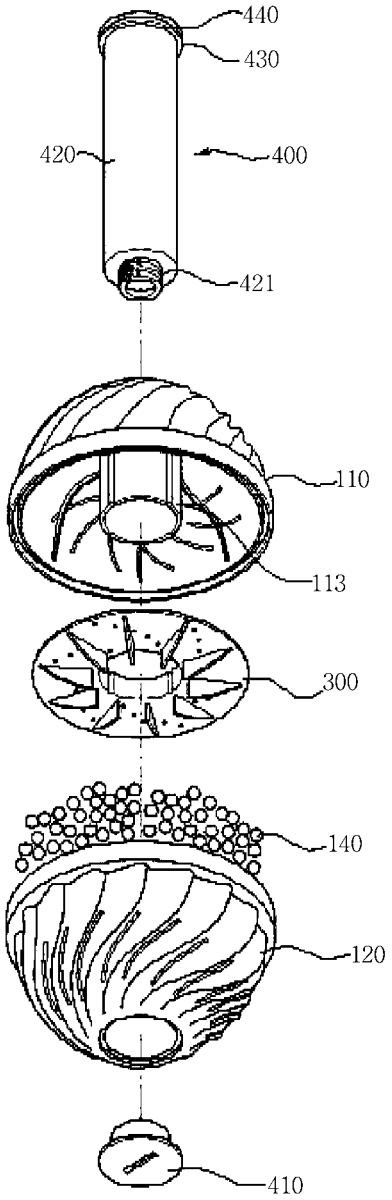
FIG. 3 is a disassembled perspective view illustrating a washing ball according to an embodiment of the present invention.

FIG. 3 is a disassembled perspective view illustrating a washing ball according to an embodiment of the present invention. Here, the washing ball 100 comprises a first tubular part 113 vertically extending from an upper center of the upper body 110; a second tubular part 123 which is formed at an inner central portion of the lower body 120 and vertically extends from the upper center while matching with the first tubular part 113; a plurality of porous ceramic balls 140 filled into both parts at the inner side of the lower body 120; a blocking cover 300 configured to prevent the leaves of the porous ceramic ball 140 filled in the lower body 120; a washing agent container 400 which is detachably inserted in the inner sides of the blocking cover 300 and the second tubular part 123; and a cap 410.

The washing ball 100 has features in that the insertion protrusion 150 formed at a lower edge portion of the upper body 110 is tightly secured, based on a rotation and melting, to the insertion groove 122 formed at the upper edge portion of the lower body 120. The engaging way might be conducted by a high frequency adhering method except for the melting method. Different types of engaging methods may be adapted except for the welding and adhering method.

The wave-shaped protrusion 111 formed in the upper body 110 protrudes in a spiral shape from the center of the first tubular part 113 to the lower edge of the upper body 110, and a through slit 112 is longitudinally formed at the descended side, and the lower boy 120 is formed in the same way for thereby effectively removing dirt with the aid of the friction with the laundry. In addition, the through slit 112 is configured to introduce the washing water and to discharge to the through slit 112 of the lower body 120 or on the contrary is configured to discharge the washing water introduced via the through slit 112 of the lower body 120. A plurality of reinforcing ribs 124 formed on the inner circumferential surfaces of the upper body 110 and the lower body 120 are ribbed in the reverse direction of the through slit 112 so as to keep the shape of the through slits 12 formed at an outer circumferential surface.

The ceramic ball used in the present invention is formed of a porous ceramic ball such as a far infrared ball emitting far infrared rays made based on the known art so as to maximize the washing efficiency, an antibacterial ball with antibacterial and sterilization functions, and an alkali ball capable of removing long stained dirt of the laundry in such a way to make the washing water alkali water. They are fixed by a blocking cover 300 so that the washing balls are filled at both sides of the lower body in such a way not collide each other and to have long effects. An insertion part 310 is formed at the center and is inserted into the second tubular part. A plurality of supports 320 prolongs in the longitudinal direction from the lower surface and are engaged with the reinforcing ribs 124 of the lower body 120 for thereby preventing the leaves of the porous ceramic ball 140. In addition, except for the porous ceramic ball, a foamed material may be additionally provided so as to prevent any abrasion due to the friction of the porous ceramic ball.

In the present invention, the porous ceramic balls 140 are filled in the lower body 120, and the washing agent container 400 is inserted at the center, which leads the center of the weight to move downward, so they can be well balanced in the washing tub in the course of washing.

Figure 4:
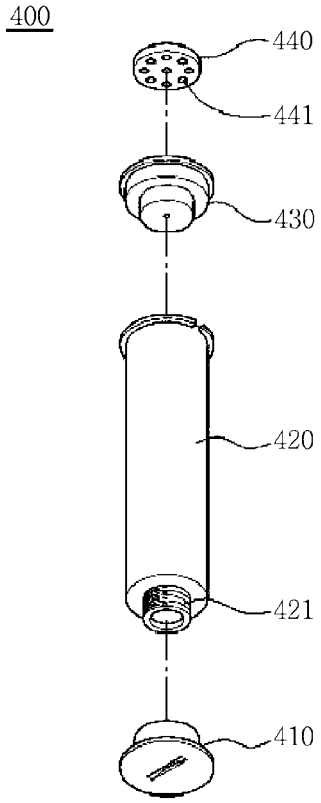
FIG. 4 is a disassembled perspective view illustrating a washing agent container according to an embodiment of the present invention.

FIG. 4 is a disassembled perspective view illustrating the washing agent container 400 according to an embodiment of the present invention. The washing agent container 400 is formed of a discharge member 440, a valve member 430, an accommodation part 420 and a cap 410. The accommodation part 420 is a hollow part to accommodate gel semi-solid washing agent, and a plurality of discharge ports 441 are formed at the discharge part 440 so that washing agent can be well discharged with the aid of external impact or the vibrations in the course of washing. Check valves 431*a* and 431*b* are formed in the interior of the valve member 430 formed near the discharge ember 440 for thereby controlling the discharge of the washing agent.

More specifically, the washing agent container 400 is installed through the first tubular part 113 vertically extending from the top center of the upper body 110 and through the insertion part 310 of the blocking cover 300 and is engaged while communicating with the second tubular part 123 of the lower body 120. The thusly inserted washing agent container 400 is engaged as the thread 421 of the accommodation part 420 is engaged with the thread (not shown) of the cap 410, and the washing agent container 400 is detachable, and the contents may be exchanged when it is all used.

The contents filled in the washing agent container 400 according to the present invention is a gel semi-solid material, preferably, a washing agent which is generally added in the course of washing such as fiber softener, aroma oil, static electricity agent, and allergy, atopic and home dust mite prevention agents.

Figure 5:
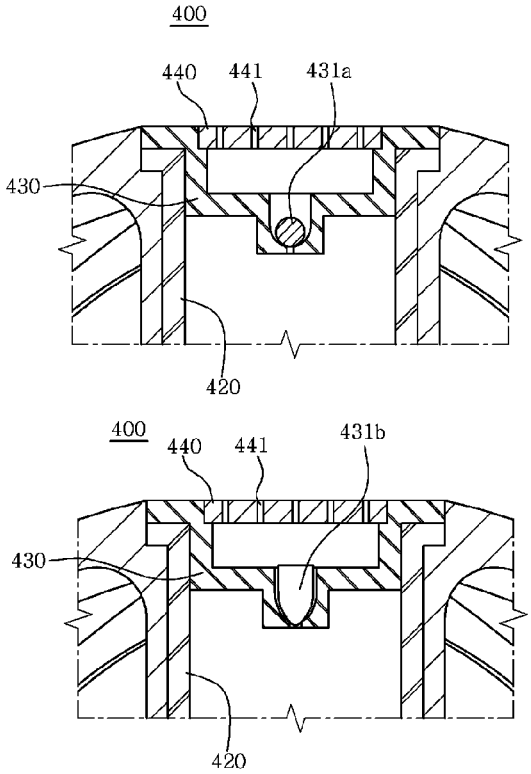
FIG. 5 is a cross sectional view illustrating a check valve according to an embodiment of the present invention.

FIG. 5 is a cross sectional view illustrating a check valve according to an embodiment of the present invention. The check valve provided at the valve member 430 in the washing agent container 400 might be formed (a) a spherical ball check valve 431*a* or (b) a conical check valve 431*b*. Various shapes of the check valve can be adapted except for the spherical shape or the conical shape. The check valve 431*a*, 431*b* is configured in an open structure so that the discharge of the washing agent is blocked by closing the discharge port 441 with the aid of gravity when the system is stopped and the washing agent can be discharged into the washing water as the check valve 431*a*, 431*b*, which has blocked the discharge port 441, moves by external impacts.

FIG. 6 is a cross sectional view illustrating a washing ball according to an embodiment of the present invention. The discharge port 441 of the washing agent container 400 is secured to the upper body, and the washing agent is discharged via the discharge port as the check valve 431*a* in the washing agent container 400 moves by means of the vibrations in the course of washing. Here, the washing agent container 400 is disposed based on the principle that washing force can be obtained by means of the potential energy which generates thanks to the head drop as the drum rotates in a state that laundry and washing water are mixed in the cylindrical drum.

FIG. 7 is a cross sectional view illustrating a washing ball according to another embodiment of the present invention. The discharge port 441 of the washing agent container 400 is secured to the lower body. As the check valve 431*ao* in the washing agent container 400 moves by the vibrations in the course of washing, the washing agent is discharged via the discharge port 441 and moves into the washing water. Here, the washing agent container 400 is inserted based on the principle that washing is conducted using water flows which generate when the wings installed below the washing tub rotate left and right.

The operations of the washing ball 100 according to an embodiment of the present invention will be described with reference to the accompanying drawings. The user inserts the washing agent container 400 in the second tubular 123 of the lower body 120, and the porous washing balls 140 are filled at both sides, and the insertion part 310 of the blocking cover 300 is inserted into the second tubular part 123 for thereby fixing the porous ceramic ball 140. Next, the lower boy 120 of the upper body 110 is tightly secured by a rotation melting method or a high frequency melting method in such a way to engage the insertion protrusion 150 and the insertion groove 120. The porous ceramic 140 is filled in the lower body 120, and the upper body 110, the blocking cover 300 and the lower body 120 are sequentially engaged and are adhered by a high frequency method. It is preferred that the washing agent container 400 may be inserted into the interior communicating with the first tubular part 112, the blocking cover 300 and the second tubular part 123.

Afterward, the washing balls 100 are inserted into the washing tub of the washing machine filled with washing water instead of inserting washing agent, and electric power is supplied to the machine, and the washing starts. Upon the start of the washing machine, the washing tube starts rotating, and the washing balls 100 in the washing tub starts rotating. As the wave-shaped protrusion 111 frictions with the laundry, the dirt stuck in each laundry is removed. The washing water comes in and goes out via the through slit 112 formed at the upper body 10 and the lower body 120, and far infrared rays are emitted from the porous ceramic ball, thus performing sterilization and pasteurization. At this time, the check valve 431*a*, 431*b* in the interior of the washing agent container starts moving based on the driving of the washing machine, so the washing agent moves via the discharge port 441 into the washing water, which leads to enhanced washing efficiency. When the contents of the washing agent container 400 is all used, the cap 410 is separated from the washing agent container 400 and is removed from the washing ball 100 and is exchanged.

As described above, the long stained dirt can be removed using the washing ball according to the present invention, and the tangling of the laundry can be prevented, and far infrared rays can be emitted from the porous ceramic balls filled inside, thus enriching surface activations of washing water along with sterilization and antibacterial operations, and the fiber softener inserted in the washing ball make the clothes to feel smooth, and static electricity can be prevented, and color losing can be also prevented, and washing agent does not remain after washing.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A laundry ball formed of a semi-spherical upper body and a semi-spherical lower body in which a plurality of spiral wave-shaped protrusions and a plurality of through slits which are continuously formed on its outer circumferential surface and reinforcing ribs are ribbed on the inner circumferential surface in the opposite direction to the through slit wherein the upper body and the lower body are engaged into a spherical shape, comprising:

a first tubular part which vertically extends from the center of the top of the upper body;

a second tubular part which is vertically extends from the center of the top of the lower body;

a plurality of porous ceramic balls which are filled into both sides of the inner side of the lower body;

a blocking cover which is configured to prevent the leaves of the porous ceramic balls filled in the lower body; and a washing agent container which is detachably inserted into the inner sides of the first tubular part, the blocking cover and the second tubular part which all communicate one another when being engaged to the upper body and the lower body, wherein the washing agent container is formed of a discharge member including a plurality of discharge ports, a valve member including a check valve, and an accommodation part which accommodates a gel semi-solid washing agent, and a thread of the accommodation part is engaged to a thread formed at an inner circumferential surface of the cap.

2. The ball of claim 1, wherein when the washing agent container is used in a drum type washing machine, the discharge port is engaged facing the upper body, and when the washing agent container is used in an ordinary washing machine, the discharge port is engaged facing the lower body.

3. The ball of claim 2, wherein the check valve is selected among a ball check valve whose valve is spherical, and a conical check valve, and in the stop mode, the check valve blocks the discharge port with the aid of gravity, thus stopping the discharge of the washing agent, and the washing agent is discharged as the check valve, which has blocked the discharge port, moves by an external impact or the vibrations in the course of washing.

4. The ball of claim 1, wherein the blocking cover includes a plurality of spiral holes at its upper surface and lower surface in order for the washing water to flow, and an insertion part is formed at its center and is inserted into the second tubular part, and at its lower surface are formed a plurality of supports which extend in a longitudinal direction.

* * * * *